US008388458B2

(12) United States Patent
Buhler

(10) Patent No.: US 8,388,458 B2
(45) Date of Patent: Mar. 5, 2013

(54) ROUND RIDE WITH LATERAL FLIGHT

(75) Inventor: Peyton B. Buhler, Burbank, CA (US)

(73) Assignee: Disney Enterprises, Inc., Burbank, CA (US)

( * ) Notice: Subject to any disclaimer, the term of this patent is extended or adjusted under 35 U.S.C. 154(b) by 313 days.

(21) Appl. No.: 12/980,545

(22) Filed: Dec. 29, 2010

(65) Prior Publication Data

US 2012/0172138 A1 Jul. 5, 2012

(51) Int. Cl.
*A63G 1/30* (2006.01)
*A63G 1/10* (2006.01)

(52) U.S. Cl. ..... 472/29; 472/32; 472/130

(58) Field of Classification Search ..... 472/6–11, 472/29, 32–34, 130
See application file for complete search history.

(56) References Cited

U.S. PATENT DOCUMENTS 1,561,073 A * 11/1925 Hanson ..... 472/10
2,031,310 A * 2/1936 Hall ..... 434/56
2,239,542 A * 4/1941 Stanzel ..... 472/32
4,898,377 A * 2/1990 Roche ..... 472/30
5,558,581 A * 9/1996 Knijpstra ..... 472/31

* cited by examiner

*Primary Examiner* — Kien Nguyen
(74) *Attorney, Agent, or Firm* — Marsh Fischmann & Breyfogle, LLP; Kent A. Lembke

(57) ABSTRACT

A round ride configured to provide lateral flight or movement of the passenger vehicle. The ride includes a vehicle support or boom arm that includes a four-bar linkage with: a base link affixed to the rotating hub; a crank or driver link rotating about a pivotal connection with this base link by a rotary actuator; a vehicle support link pivotally connected at one end to the crank or driver link to move with this link and at a second or outboard end to a coupler that supports the vehicle; and a follower or connector link pivotally connected at its ends to the base link and vehicle support link. As the crank or driver link is rotated, the guest compartment moves along a motion profile defining irregular vertical movement (not simply a preset arc) and providing lateral movement, which changes the ride dynamics including changing vehicle velocity with varying vehicle radii.

17 Claims, 6 Drawing Sheets

ROUND RIDE WITH LATERAL FLIGHT

BACKGROUND

1. Field of the Description

The present description relates, in general, to amusement park rides and other entertainment rides such as round rides, and, more particularly, to amusement or theme park round rides configured to position a vehicle at numerous radii through movement of a coupler (or vehicle coupling point) on an end of a support arm through an irregular motion profile. The support arm is attached at an opposite end to a central hub that is rotated about a central or rotation axis at one or more speeds.

2. Relevant Background

Amusement and theme parks are popular worldwide with hundreds of millions of people visiting the parks each year. Park operators continuously seek new designs for rides that attract and continue to entertain park visitors. Many parks include round rides that include vehicles or gondolas mounted on support arms extending outward from a centrally located structure that is rotated by a drive assembly. The passengers or riders sit in the vehicles (or guest/rider compartments) and are rotated by the drive assembly, which spins the hub structure about its central axis.

In some of these rides, the passengers may operate an interactive device, such as a joystick in the vehicle, to make the support arm and their attached vehicle gradually move upward or downward within a limited, preset range such as by pivoting the support arm at its connection to the central hub. Some rides also allow the passengers to control the pitch of their vehicle.

Even with these added features, it is difficult to provide a round ride that attracts repeat riders because the ride experience is repetitive and predictable. For example, the support arm typically has a fixed length, and the vehicle is rigidly or pivotally mounted at a fixed location on the support aim. As a result, the radius at which the vehicle rotates about the central hub or rotation assembly does not vary much throughout the ride. This results in a motion profile with a generally fixed or constant radius and a fixed vertical path (e.g., the passenger may be able to use a joystick to move their vehicle up and down in a predefined arc). The available round rides have a limited and very predictable set of ride dynamics, such as centripetal force applied to the vehicle and vehicle speed, which are unchanging or vary only within a small range. These rides may be thought of as single degree-of-freedom (DOF) rides with a single user or rider input.

There remains a need for new round rides that improve the ride experience such as by providing a larger range of ride dynamics, e.g., bigger range of vehicle speeds, while retaining the benefits of a rotating structure or round ride including a small footprint, simple control systems, and relatively low construction and maintenance costs. For example, it may be desirable to provide a round ride with each vehicle having a motion profile that includes lateral movement (or "lateral flight") in relation to the center of the rotating hub.

SUMMARY

The present description teaches a new round ride or rotating hub ride that is configured to position passenger vehicles at different vehicle radii relative to the hub's axis of rotation. This is achieved by utilizing a vehicle support or boom arm that includes a four-bar linkage with a base link affixed to the rotating hub, a crank or driver link rotating about a pivotal connection with this base link by a rotary actuator (e.g., one operated by a joystick or other input device in the support guest compartment or vehicle), a vehicle support link pivotally connected at one end to the crank or driver link to move with this link and at a second or outboard end to a coupler that supports the vehicle, and a follower or connector link pivotally connected at its ends to the base link and vehicle support link. As the crank or driver link is driven through a 360-degree rotation (clockwise or counterclockwise) the guest compartment is moved along a motion profile that defines a path with irregular vertical movement (not simply a preset arc) and, significantly, with lateral movement (or "lateral flight") so as to change the ride dynamics such as by changing vehicle velocity (with changing vehicle radius) and accelerations experienced by the vehicle passengers.

More particularly, a ride apparatus or round ride is described that allows each of the passenger vehicles to have unique lateral flight. The ride includes a drive assembly including a drive and a hub rotated, during operation of the drive, about a central axis of rotation. The ride also includes a passenger vehicle (e.g., a plurality of such vehicles about the periphery of the hub). The ride also includes a vehicle support assembly including a coupler supporting the passenger vehicle. Interestingly, the vehicle support assembly includes a four-bar linkage including a base link attached to the drive assembly to rotate with the hub and a vehicle support link with an outer end connected to the coupler. Typically, the four-bar linkage further includes a driver link pivotally connected at a first end to the base link and at a second end to an inner end of the vehicle support link. The ride further includes an actuator operating to rotate the driver link about its connection point with the base link.

In practice, when the driver link is rotated about the connection point, the passenger vehicle is moved along a motion profile with a path that positions the passenger in a vehicle in a range of vertical positions and a range of lateral positions relative to the center axis of rotation, such that the passenger vehicle has lateral movement (e.g., a lateral movement that exceeds 2 feet such as in the range of 4 to 10 feet or more of changes in vehicle radius). The four-bar linkage may be configured such that the vertical positions in the path do not define a simple arcuate path and may include at least two differing vertical movement paths (e.g., an outer vertical path or stroke that has one irregular Shape and an inner vertical path or stroke that has another, different irregular (or not simply an arc) shape.

The ride may be a single degree-of-freedom (DOF) input ride with the actuator operating in response to signals from a user input device on the passenger vehicle. The driver or crank link may move in either direction, e.g., the signals cause the actuator to alternately move the driver link in a clockwise direction and a counterclockwise direction. In some embodiments of the ride, the four-bar linkage further includes a follower link pivotally connected at a first end to the base link and at a second end to the vehicle support link at a coupling point. In some cases, the coupling point is at a midpoint between the inner and outer ends of the vehicle support link such that the vehicle support link includes a cantilevered portion extending outward from the coupling point and supporting the passenger vehicle (e.g., a cantilevered portion having a length of 6 to 12 feet or more in some embodiments). The cantilevered portion may extend linearly outward from the coupling point or the cantilevered portion may extend outward from about the coupling point at an angle with an absolute value of greater than about 15 degrees (such as have a value of −15 to −60 degrees as measured from a longitudinal axis of the vehicle support link between the inner end and coupling point).

DETAILED DESCRIPTION

Figure 1:
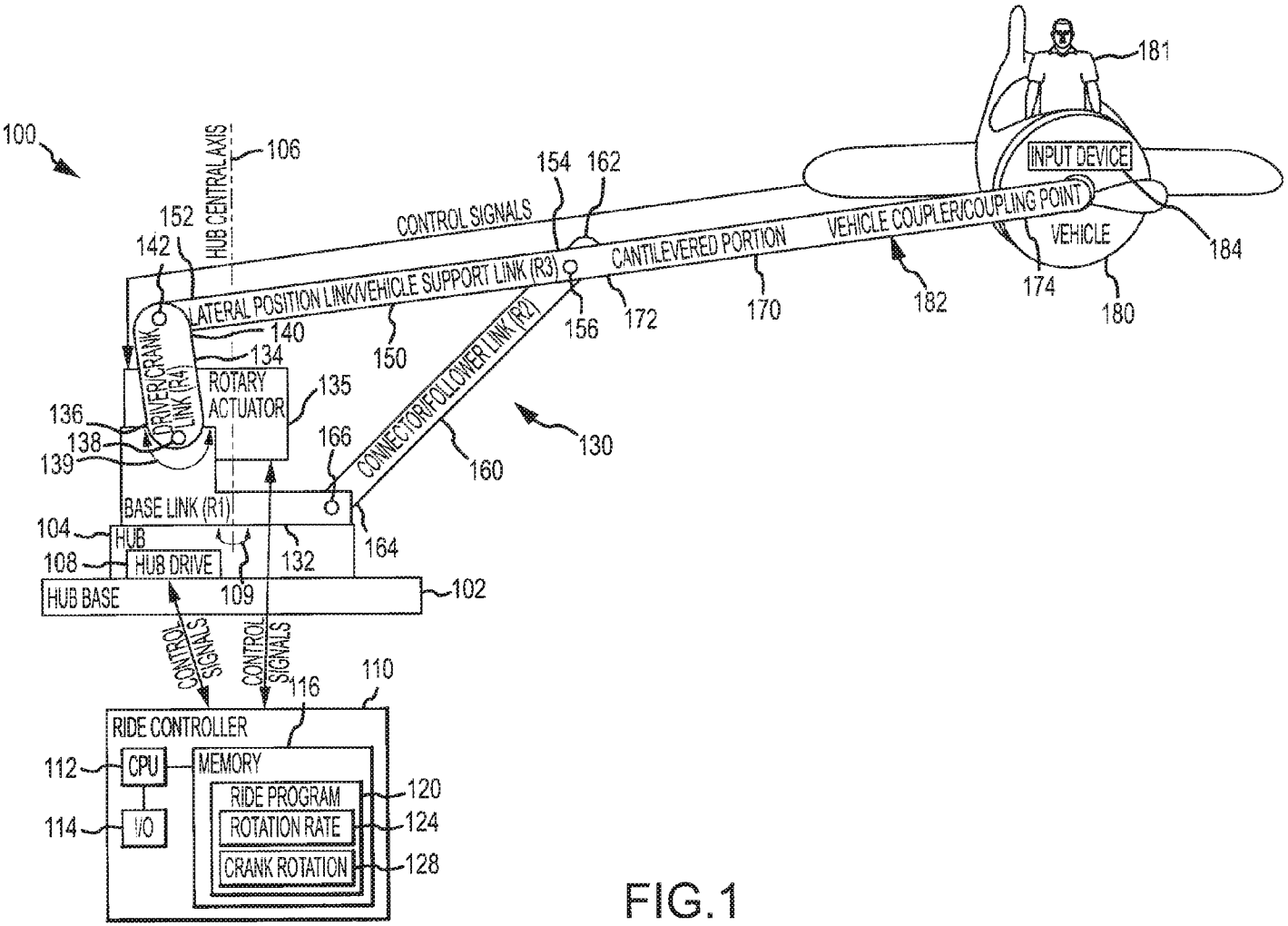
FIG. 1 is a functional block or schematic drawing of a round ride configured to provide lateral flight/radial movement to a vehicle by supporting the vehicle in a vehicle support arm (or boom) assembly including a four-bar linkage attached to the rotating central hub structure.

The description is generally directed to an amusement park ride (or round ride system) that provides a fun and exciting ride experience utilizing a simple rotating structure (e.g., a rotating central hub). In contrast to prior round rides, though, the amusement park ride replaces the conventional boom arm used to support a passenger vehicle (or guest compartment) with a boom or support arm assembly that includes a four-bar linkage.

Briefly, a base or first link is attached to the hub structure to rotate with the hub about its center axis while a crank/driver or second link and follower or third link are used to pivotally support a vehicle support or fourth link, which supports the vehicle at a distal end (or coupling point) spaced apart from the hub structure. A rotary actuator is operated, such as based on rider input from a joystick or other input device in the vehicle, to rotate the crank or driver link about a pivot point or axis on the base link, and this causes the vehicle support link to move the coupling point and supported vehicle through an irregular motion profile instead of a limited and fixed vertical arc so as to achieve lateral flight for the vehicle (e.g., varying radii for the vehicle over the motion profile or path followed by the coupling point with movements of the four-bar linkage).

In other words, in order to provide lateral movement to the guest compartment on the round ride, a four-bar linkage with a vehicle/compartment coupler at an end of the driven or vehicle support link is used as a replacement for the traditional boom arm. The guest compartment is mounted using the coupler such as for free or controlled pivoting of the compartment with movement of the support link. As the driver link or crank is rotationally driven, the guest compartment follows a path or motion profile that has motion both in a vertical and a lateral direction (e.g., at least 2 feet and more typically at least 4 feet of change/delta in vehicle radius during movement of the vehicle through the motion profile). Such lateral direction movement provides "lateral flight" for the guest compartment and its passengers that was not provided with prior round rides.

As will become clear to those skilled in the arts, there are several advantages to the round ride with lateral flight described herein. First, the round ride provides lateral movement or flight with a relatively simple mechanical design and structure. Traditional round rides have one linear actuator that moves the rigid, fixed-length arm up and down (e.g., changing the arm angle and height of the supported vehicle), which is a single degree-of-freedom (DOF) input. The new round ride also may use a single DOF input, but it uses a rotary actuator, which drives the crank or driver link of the four-bar linkage, rather than the linear actuator. Second, the output motion achieved is much more complex than prior round rides and includes a substantial amount of lateral movement (e.g., 2 to 4 feet or more change in vehicle radius). This means that the same rider input (e.g., a rider may operate a joystick in the vehicle to move their vehicle through the motion profile) may be used to provide a more complex, unexpected, and fun output motion for the vehicle (coupling point or outer end of the vehicle support link).

A third and significant advantage provided by the round ride is the ability to provide lateral motion or flight that gives the rider in the guest compartment or vehicle a dynamic ride experience with varying (or a plurality of) centripetal accelerations. As the distance between the center of hub (center or rotation axis of the hub) and the vehicle is varied with changing positions of the vehicle on the motion profile, the lateral G-forces also vary (e.g., the vehicle velocity increases with greater radii even at the same rotating angular velocity). Fourth, in some embodiments, the rider may control the motion by operating an input device within or on the vehicle. For example, the rider or passenger may be able to choose to initiate or stop movement of their vehicle around the motion profile defined by the boom arm assembly configuration (e.g., length of each link, whether the support/boom link is straight, curved, or angled upward or downward in its cantilevered portion, and so on), and they may choose to move in either direction (in a clockwise or counterclockwise direction).

As a fifth advantage, the round ride provides an improved sight line. In conventional round rides, a passenger's vehicle is nearly always directly behind the preceding vehicle(s), which sometimes results in a blocked view or a limited view of the leading passengers and the back of their vehicle. The new round ride with its irregular lateral and vertical movement allows the passenger to position their vehicle to the left and right as well as up and down along the motion profile (or coupling point path) to improve or at least control their sight line and view during the ride.

As a sixth advantage, some embodiments of the round ride include a plurality of vehicle assemblies with at least two differing support or boom arm assemblies used to support vehicles. In this way, two or more four-bar linkage designs may be used to define differing motion profiles for different subsets of the vehicles. This adds another layer of variability to the ride and the passengers' dynamic ride experience (e.g., differing magnitudes of lateral movement to provide more or less G-forces or centripetal accelerations, differing motion profiles to provide more open (or less blocked) lines of sight for adjacent vehicles, and the like). For example, the round ride may be set up with alternating four-bar linkage designs that differ so as to cause leading and trailing vehicle pairs to always (or at least partially) be at differing vehicle positions (e.g., differing either in height or radius or both in height and radius depending on the goals of the ride designer/operator) such as by having adjacent vehicles following fully or partially differing motion profiles (or coupling point travel paths in response to driving the crank or driver link of the four-bar linkage).

FIG. 1 illustrates an exemplary round ride system 100 with lateral flight that may be used to position a passenger vehicle 180 at differing radii and vertical positions so as to create differing ride dynamics (e.g., inward and outward lateral movement, varying sightlines, changing vehicle velocities, and so on). The ride system 100 includes a platform or hub base 102 upon which is mounted and supported a drive and support assembly with a hub or central rotating structure 104.

The ride system 100 includes a drive(s) and other components 108 to rotate the hub 104 about its central axis or axis of rotation 106 at one, two, or more rotation rates (e.g., $v_{Hub}$) as shown with arrow 109 in one of two directions, but with some embodiments rotating only in one direction such as clockwise or counterclockwise. In one non-limiting example, the drive and support assembly with the hub base 102, hub 104, and drive 103 is configured similar to a hub structure of a traditional round iron ride (but supporting differing boom arm assemblies 130). Specifically, the drive and support assembly may take the form of one of the drive and support assemblies designed and distributed by Zamperla Inc., 49 Fanny Road, Parsippany, N.J., USA or assemblies provided by other similar ride design and production companies. Often, the drive 108 of such an assembly may operate at relatively low speeds such as less than about 20 revolutions per minute (RPM) and more typically less than about 10 RPM such as about 6 RPM in some cases. In one embodiment, the hub 104 is rotated 109 at rates that vary from about 6 RPM to a maximum rotation rate in the range of 10 to 20 RPM (or higher), which may provide a wide range of centripetal accelerations and G-forces depending upon the design of the boom arm assembly 130 and the location of the vehicle 180 on its motion profile (which defines the vehicles lateral position or vehicle radius relative to axis 106).

FIG. 1 illustrates the ride system 100 in functional block form to facilitate description of how a ride and its components may be controlled and operated. The ride system 100 is shown to include a ride control system or controller 110, e.g., a computer or electronic device using a combination of hardware and software to perform ride control functions such as to control operation of the hub drive 108 and arm positioning via a rotary actuator 135. The control system 110 may include a hardware processor(s) 112 that manages operation of input/output devices 114 and memory/data storage 116 (e.g., computer readable media, digital data storage devices, and the like). The I/O devices 114 may include keyboards, mice, touchscreens/touchpads, monitors, printers, and the like that allow an operator of the control system 110 to input data/commands and to view ride data such as operating status of the ride including present positions of vehicles on motion profiles and hub rotation rates. For example, an operator may initiate a ride program 120 that may define ride profiles that determine or define hub rotation rates 124 used to control hub drive 108 with signals (that may be provided in a wired or wireless manner) and other ride parameters.

These other parameters may include crank rotation settings 128 used by the program 120 to define operation of the rotary actuator 135 via control signals (again, sent by wired or wireless transmission via I/O or other devices 114 of controller 110). For example, the controller 110 may cause the rotary actuator 135 to rotate the crank or driver link 140 as shown by arrow 139 in the clockwise or counterclockwise direction about pivot point 138 (or an axis extending generally through pivot point 138) so as to selectively move and/or position the vehicle 180 at positions along its motion profile (e.g., a path defined by the coupling point 174 as the four-bar linkage of assembly 130 is operated).

The ride program 120 typically is a software program/application (e.g., code devices) that causes the processor 112 or other portions of control system 110 to perform the functions described herein such as transmitting control signals to operate a central drive 108 to rotate 109 the hub at one or more particular rotation rates set by a ride program 120 as shown at 124 or as may be manually entered by an operator via I/O devices 114. The ride program 120 may also use crank rotation settings 128 to operate rotator actuator 135 to drive 129 crank or driver link 134. Alternatively or additionally, the ride program 120 may also include a passenger input processor routine (not shown) that processes passenger input from an input device 184 in/on vehicle 180 to then generate control signals to operate the rotary actuator 135 when the rider 181 is allowed to control movement of the vehicle 180 about its motion profile.

Significantly, though, the ride system 100 replaces a conventional rigid support or boom arm that provides only one arm length with a support or boom arm assembly 130. The arm assembly 130 includes a four-bar linkage that supports a vehicle 180, adapted for one, two, or more passengers 181, at a coupling point 174 with a coupler 182 (which may allow free or controlled pivoting of the vehicle 180 or rigidly retain the vehicle 180). The use of a four-bar linkage allows the arm assembly 130 to move the coupling point 174 and supported vehicle 180 through a path corresponding with a motion profile, which preferably provides a varying radius for the vehicle 180 relative to the hub's central axis 106 as well as a range of vertical positions or vehicle heights relative to the hub base 102.

Specifically, the arm assembly 130 includes a first or base link 132 (also labeled as "R1") that is affixed to the hub 104, such as on one of its upper surfaces, so as to structurally support the assembly 130 and vehicle 180 and also so that the base link 132 rotates 109 with the hub 104 about the axis 106. In another embodiment, though, the arm assembly 130 may be supported from a lower surface of the hub 104 so as to make the ride 100 a suspended-type round ride and such concepts are considered within the breadth of this description. The arm assembly 130 further includes a driver link or crank 134 (also labeled as "R4") that is pivotally mounted at a first end 136 to the base link 132 so as to pivot about point 132 as shown with arrow 139. The ride system 100, as discussed above, includes a rotary actuator 135 that operates to rotate 139 the crank 134 about pivot point 138 (e.g., 360 degrees in clockwise and/or counterclockwise direction relative to an axis passing through point 138).

Each vehicle 180 may include one or more passenger input devices 184 that allow passengers 181 to interact with the ride 100. For example, the input device 184 (e.g., a joystick, a touchscreen, a switch/lever, or the like) may be provided on the vehicle 180 to allow a passenger of the vehicle 180 to provide input signals to the ride control system 110 (or directly to the rotary or boom assembly actuator 135). The ride control system 110 may act upon this input to control with control signals the corresponding actuator 135 to move the arm/track up or down and also in and out laterally by rotating 139 the driver or crank link 134 about pivot point 138.

The arm assembly 130 further includes a lateral position or vehicle support link 150 (also labeled as "R3") that extends outward from the hub 104. The vehicle support link 150 is typically an elongate member (e.g., a beam, rod, or the like) that may be straight as shown in FIG. 1, be curved or other non-linear shape, or angled upward or downward outboard from a pivot/connection point 156. The support link 150 includes a first or inner end 152 that is pivotally connected to the second end 140 of the driver link 134 at a pin or pivot point 142. The arm assembly 130 further includes a connector or follower link 160 (also labeled "R2" in FIG. 1), which may be an elongated member pivotally connected/supported at a first end 164 at pin or pivot point 166 to the base link 132.

The follower link 160 is also pivotally connected at pin or pivot point 156 at a second end 162 to the vehicle support link 150 at a pivotal support portion 154. The pivotal support portion or location 154 typically is a midpoint between the vehicle support link's inner or first end 152 and a second outboard end or coupling point 174 with the vehicle 180. A vehicle coupler 182 is provided at this point or end 174 of the link 150. As shown, the link 150 may include a cantilevered portion 170 that extends outward or outboard from the hub 104 and pivot or connection point 156 at location 154 from a first end 172 to a second end 174 or coupling point where it supports the vehicle coupler 182. The vehicle coupler 182 may take many forms to practice the system 100 and is generally provided to support the vehicle 180 on a coupling point 174 a radial distance from the hub central axis 106. The length and configuration (angled, curved, and so on) of the cantilevered portion 170 is chosen to achieve a desired set of radii for the coupling point 174 and vehicle 180 as well as to achieve a desired motion profile given the configuration of the other links 132, 134, 160 as well as the length of inboard portion of vehicle support link 150 between pivot points 142, 156.

Figure 2:
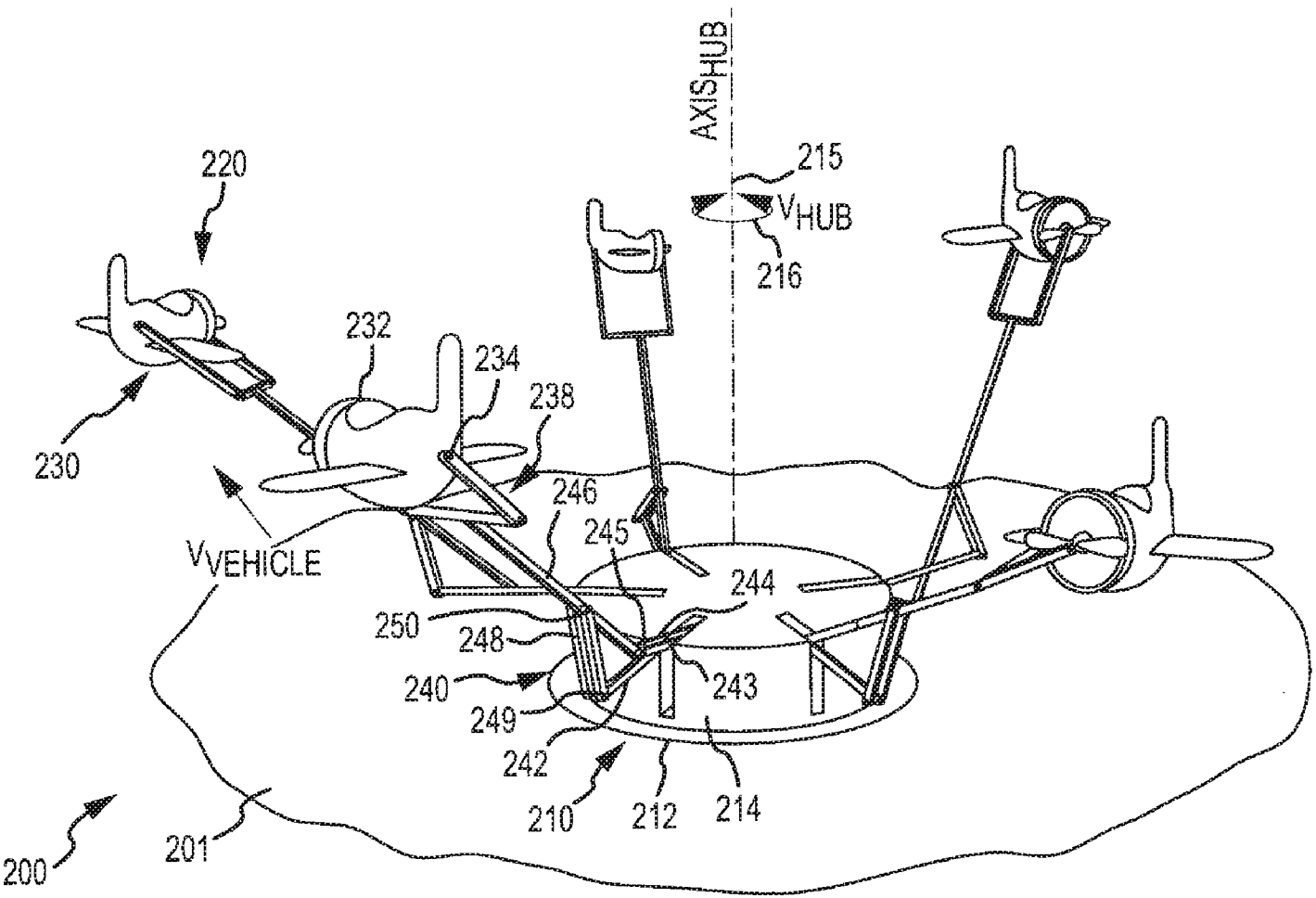
FIG. 2 is a perspective view of a ride system that includes a plurality of vehicle assemblies including vehicles supported on the end (at a coupling point) of a support arm or boom assembly made up of a four-bar linkage.

Before turning to specific motion profile examples achieved with a four-bar linkage-based support arm, it may be useful to describe an exemplary ride system that uses such support arms to provide new ride experiences. FIG. 2 shows a round ride 200 with lateral flight for its vehicles. The round ride 200 includes a drive and support assembly 210 with a hub platform or foundation 212 supporting a hub structure 214. During operation of the ride 200 (e.g., after loading vehicles with passengers or riders), the hub structure 214 rotates as shown with arrow 216 about a center axis 215 at one or more velocities, $v_{Hub}$ (such as clockwise or counterclockwise at up to 6 RPM or more). The center hub, in some embodiments, may rise vertically a few feet at or before the start of rotational motion to lift vehicles up from their loading position. One reason for performing such a hub lift may be based on the shape of the guest/passenger compartment and its ease of loading. For example, if a guest compartment needs to be very low to the ground for ease of loading, then the ride 200 may be configured to lift the compartment up before beginning rotation/flight so that when it is spinning at full rotational velocity the guests cannot command their vehicles/arms to a furthest downward position that may be within reach of the ground/foundational platform.

The ride 200 includes a plurality of vehicle assemblies 220, 230 spaced apart on the hub 214 and supported so as to rotate with the huh 214 about axis 215. In some embodiments, the adjacent assemblies 220, 230 are configured with identical boom arm assemblies, while some preferred embodiments may call for these boom arm assemblies to differ in their four-bar linkage configuration so that adjacent assemblies 220, 230 provide motion profiles for the supported passenger vehicles that are at least different in a portion of the path they define for the vehicles. In this manner, a trailing vehicle such as vehicle 232 may have a different ride experience (more or less centripetal accelerations, G-forces, and so on) and/or differing lines-of-sight such that the leading vehicle such as the one in assembly 220 is not blocking (directly in front of the vehicle 232) in portions of or for the entire rotation of the hub 214.

Each vehicle assembly in ride 200 may be configured as shown in FIG. 1 with a four-bar linkage-based support arm or boom. For example, the vehicle assembly 230 includes a passenger vehicle 232 that has a velocity, $v_{Vehicle}$, that depends on several variables including the rotation rate, $v_{Hub}$, of the hub 214 about axis 215 and a radial distance (or vehicle radius) of the vehicle 232 from the axis 215 (as measured, for example, from axis 215 to coupling point 234 of vehicle 232 to arm assembly 240). The vehicle assembly 230 further includes a coupler or coupler assembly 238 that pivotally supports the vehicle body 232 about a pivot or coupling point 234. Again, the coupler 238 may take many forms to practice the invention and the ride 200 is not limited to a particular implementation. The coupler 238 is attached to an outboard end or portion of the vehicle support link 246.

Significantly, the vehicle assembly 230 includes a boom arm assembly 240 that is affixed to the hub 214 and supports the vehicle 232 so as to allow the vehicle 232 to have lateral flight/movement as well as to move up and down vertically. The boom arm assembly 240 takes the form of a four-bar linkage with a base link 242 attached to the hub 214. The four-bar linkage further includes a crank or driver link 244 pivotally attached at a first end to the base link 242 such that it can be driven to rotate about this pivot point 243 on the base link 242 (e.g., by a rotary actuator not shown in FIG. 2 that may be programmed, be operated at a predefined manner with rotation 216, and/or be operated in response to inputs from vehicle 232). The crank 244 is pivotally attached at a second end at pivot point or pin connection 245 to an end of a vehicle support link 246, which may be considered a third link in the four-bar linkage of assembly 240.

A fourth or follower link 248 connects the base link 242 to the vehicle support link 246 with pivotal connections 249, 250 at its ends (or other portions of the link 248). The connection or pivot point 250 may be proximate to the coupler 238 and vehicle 232 or be offset some distance as shown to provide a cantilevered portion of the vehicle support link 246 to achieve a desired motion profile and/or radial offset of the vehicle 232 from the hub 214 and its axis 215 (and, in some cases, to hide or disguise the use of the four-bar linkage to achieve the unique and unpredictable motion profile of the vehicle 232 during operation of the ride 200).

Figure 3:
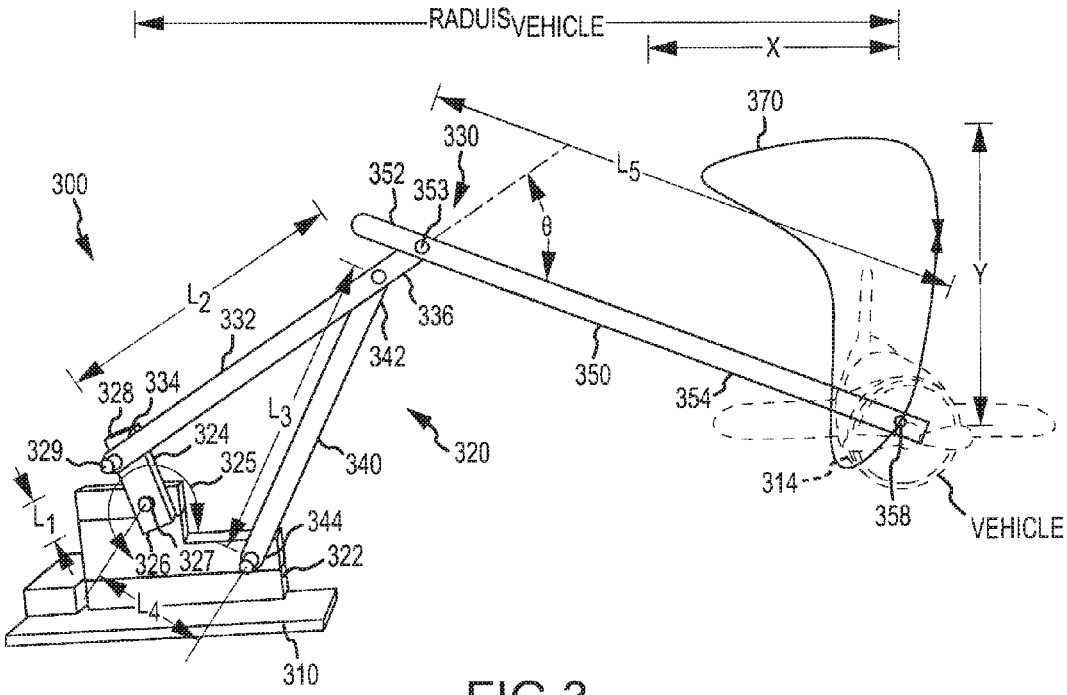
FIG. 3 illustrates a vehicle assembly showing a simplistic support arm or boom assembly useful for moving a vehicle through an irregular motion profile with lateral movement or flight varying the vehicle radius (with the vehicle and its motion profile shown schematically)

FIG. 3 illustrates a partial view of a round ride 300 showing a single vehicle support or boom arm assembly 320 and its operation to provide a motion profile 370 to a vehicle 314. In the ride 300, the aim assembly 320 is affixed at a first end to a portion of the hub 312 with a base or first link 322. At a second end 354 (e.g., an outboard end of a cantilevered portion 350 of the vehicle support link 330), the assembly 320 supports (pivotally or rigidly) the vehicle 314 at coupling point 358.

The radius, $Radius_{vehicle}$, of the vehicle 314 may be measured between the coupling point 358 and a center axis of the hub 310 or to a pivot point 327 of a crank or driver link 324. As the arm assembly 320 is operated, the lateral position of the coupling point 358 is changed as shown with "x" in FIG. 3 so as to decrease and increase the vehicle radius, $Radius_{vehicle}$, as the coupling point 358 is moved through the motion profile 370, such as a change of at least about 2 feet, in some cases at least about 4 feet, and more lateral movement or flight "x" in other embodiments of profile 370 (which is based on assembly 320 configuration). The lateral movement achieved may be stated for a profile 370 as a percentage of the vertical rise (x/y), which may be at least about 25 percent with the illustrated profile providing lateral movement of 50 to 60 percent of the vertical movement in profile 370. Likewise, the coupling point 358 may be used to define a change in vertical location (as shown with "y" in FIG. 3) or height of the vehicle 314 such as from a load/unload or lowest position to maximum heights as the coupling point 358 is moved through the path of the motion profile 370.

In addition to the base link 322, the boom arm assembly 320 includes a second or follower link 340 pivotally attached at a first end 344 to the base link 322 and at a second end 342 to the vehicle support link 330 (near an end 336 of inboard portion 332). The third link of the four-bar linkage of assembly 320 is provided by an inboard portion 332 of the vehicle support link 330, which is connected at a first or inboard end 334 to a driver link 324 and at a second or outboard end 336 to the connector or follower link 340.

The vehicle support link 330 further includes a cantilevered or outboard portion 350 that is rigidly affixed at location/pin 353 at a first or inboard end 352 to the second or outboard end 336 of the inboard portion 332 of the vehicle support link 330. At a second or outboard end 354, the cantilevered portion 350 supports the vehicle 314 such as at a coupling point(s) 358. As shown, the outboard portion 350 is mounted to be at an angle, θ, relative to the inboard portion 332 (or its longitudinal axis). This may be useful in better positioning the vehicle 314 to achieve a desired ride profile 370, to facilitate loading/unloading (e.g., place the vehicle 314 at a low point in profile 370 that coincides with a load/unload platform (not shown)), or achieve another goal of the designers of ride 300. As shown, the offset angle, θ, is in the range of −30 to −60 degrees, but a large range of offset angles, θ, may be used such as −60 to +60 degrees. In other cases, the cantilevered portion 350 of link 320 is non-linear such as arcuate in shape to selectively position the coupling point 358 relative to the pivot point/connection between inboard portion 332 and follower link 340 (between link ends 336 and 342).

The four-bar linkage of assembly 320 further includes a fourth or crank link 324 that is driven by an actuator (not shown in FIG. 3) to rotate 326 about a pivot point 327. The crank 324 is coupled with the base link 322 at a first end 326 to pivot about point 327 and is coupled with an end 334 of the inboard portion 332 of vehicle support link 320 at a second end 328 so as to provide pivotal connection/point 329 between these two links/members of the four-bar linkage. As shown, when the crank 324 is driven 325 (e.g., 360 degrees in the clockwise or counterclockwise direction), the coupling point 358 of coupler 356 and the supported vehicle 314 are driven through a path defined by the motion profile 370. This causes the vehicle 314 to move through a range of both vertical positions (as shown by the "y" range) and lateral positions (as shown by the "x" range).

The changes of lateral position (or "x" value) is typically substantial and not just a small predefined arc but 2 to 4 feet or more, which substantially affects the magnitude of the vehicle radius, $\text{Radius}_{Vehicle}$, and ride dynamics experienced in/by vehicle 314. The motion profile 370 may vary widely to implement the ride 300, and it will vary mainly with the lengths between the pivot points connecting the four links 324, 332, 340, 322 as shown by $L_1$ to $L_4$ and also based on the length, $L_5$, and the offset angle, θ. As shown, the lengths are arranged in increasing order from $L_1$, $L_4$, $L_3$, $L_2$, $L_5$, with $L_1$ of the driver link being the smallest and $L_5$ being the largest, but this is not a requirement to implement ride 300. Note, this arrangement achieves a rider-perceived, irregular and unpredictable shape for the motion profile 370, which provides differing rates of change for the vertical and/or lateral position of the coupling point 358 and vehicle 314 as the link 324 is driven 325 about point 327.

In some embodiments, the lowest vertical point of the motion profile 370 may coincide with the load/unload point for the ride 300. The vertical travel (changes in "y") for the vehicle 314 (and coupling point 358) is along an irregular path which makes the ride experience much different from existing rides. Vertical travel is not along a predefined arcuate path but, instead, is on a path 370 that may include two differing vertical travel paths, e.g., an inner and an outer path that differ from each other in their shape and/or amount of concurrently lateral travel provided in the vertical/up-down strokes. Generally, the vehicle radius, $\text{Radius}_{vehicle}$, is chosen to be large enough to provide entire motion profile 370 a reasonably large offset distance from hub 310 (such as at least about 10 to 15 feet from an inner most part of profile 370 to hub center axis or the like). The coupler 356 may be a fixed coupling or may take other forms (e.g., a four-bar linkage may also be used to provide the coupler 356) to practice the ride 300.

As will be appreciated, the ride experience including the motion profile 370 shape and size may be altered or selected by choosing and/or adjusting one or more ride design variables. For example, one variable is where the coupler point 358 is located upon the fixed link 320. Another variable for ride 300 is each length of the links 322, 324, 332, 340. A further variable that may be adjusted to affect ride experience is the pivot locations/coupling points between each pair of the interconnected links (such as between driver link 324 and vehicle positioning link inboard portion 332, between base link 322 and follower link 340, and so on). Use of four-bar linkages causes the vehicle 314 to move at differing instantaneous speeds along the motion profile 370, which further adds to the dynamic/changing ride experience of passengers in the vehicle 314.

Figure 4:
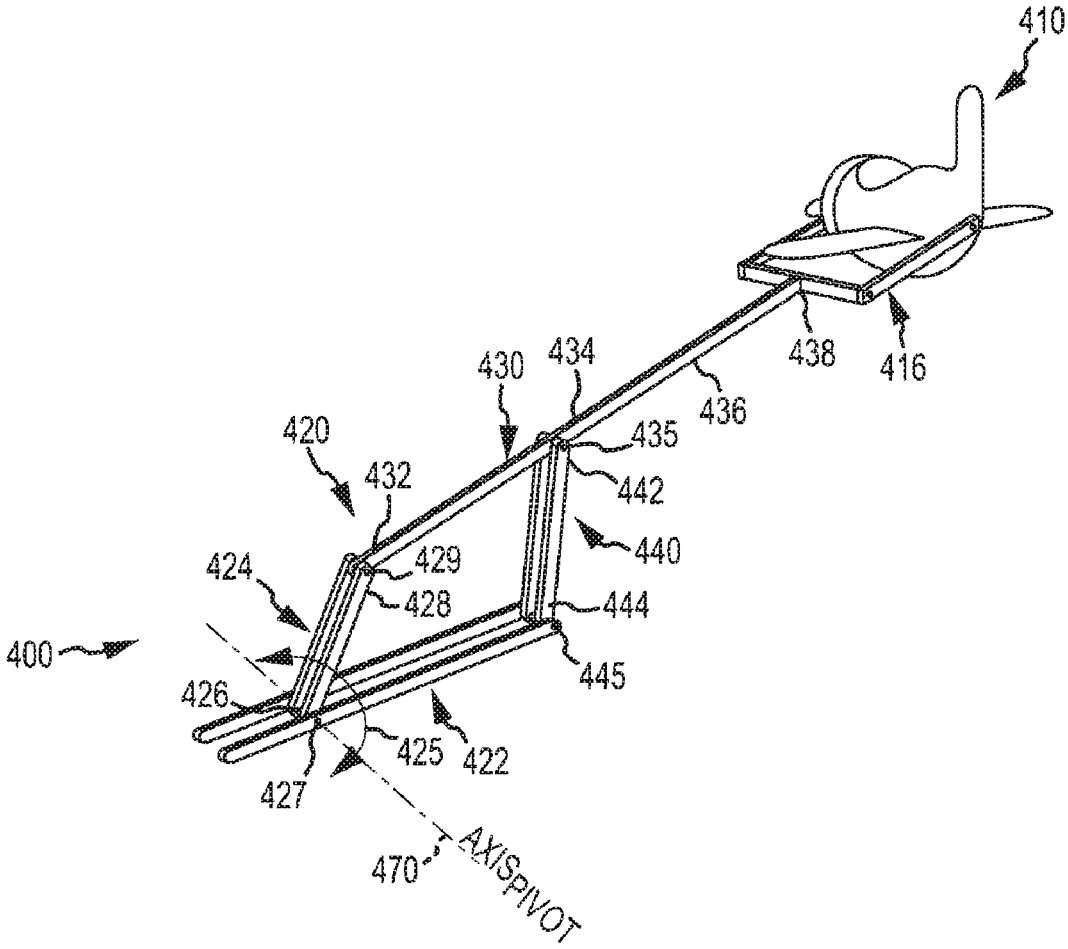
FIGS. 4-6 illustrate a vehicle assembly with its 4-bar linkage-based support arm assembly in three positions due to crank or driver link movements (e.g., by a rotary actuator (not shown in FIGS. 4-6)).
Figure 5:
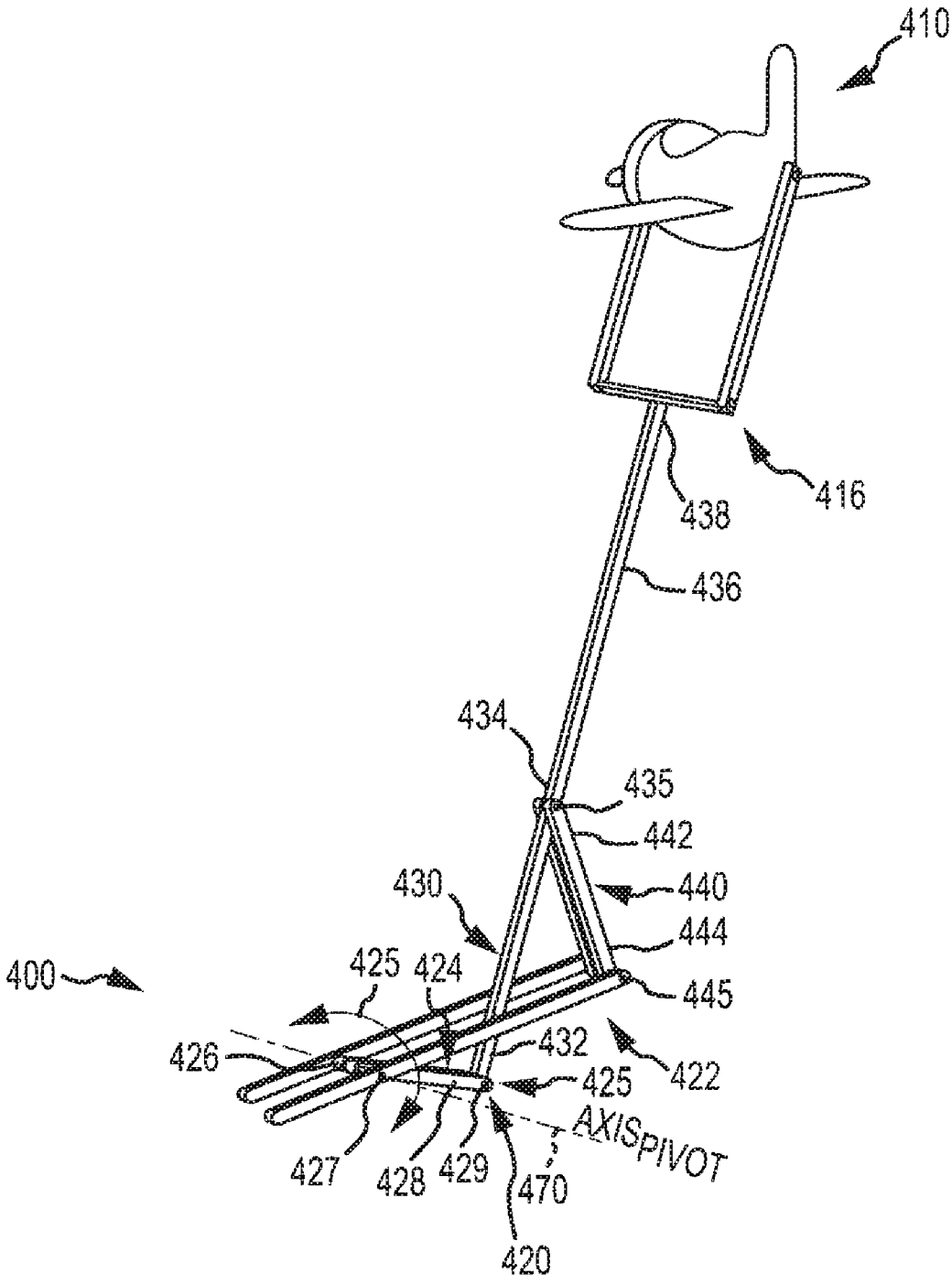
Figure 6:
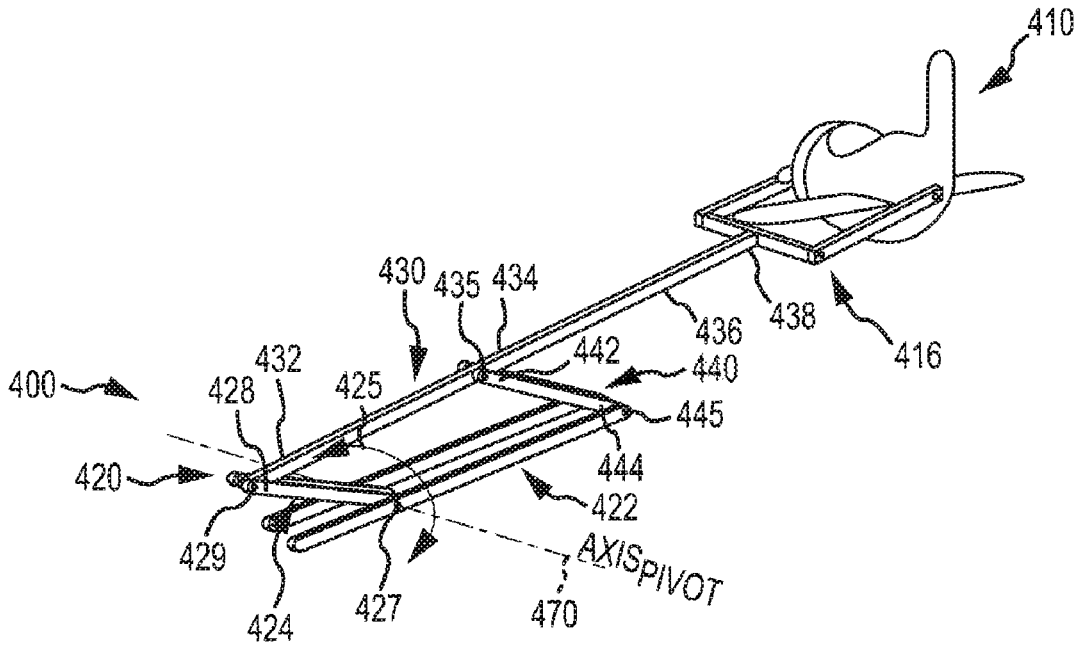

FIGS. 4-6 illustrates a vehicle assembly 400 in several states of operation, i.e., three rotational positions or stages of the crank 424 in response to a rotary actuator (not shown). As shown, the rotation 425 of the crank 424 causes the vehicle 410 to move to three differing positions on the motion profile defined by the configuration of the assembly 400. By studying FIGS. 4-6, the reader is readily able to understand via visualization how the vehicle 410 is moved through a unique path that includes lateral movement or lateral flight in addition to vertical movement (along an irregular or not a single arcuate path).

As shown, the vehicle assembly 400 includes a boom arm assembly 420 including four-bar linkage with the following elements: a first/base link 422; a second/crank link 424; a third/vehicle support link 430; and a fourth/follower link 440. The base link 422 would be attached to a hub surface so that the assembly 400 is rotated with the central hub structure of a round ride. The drive link 424 is pivotally mounted via pin or at pivot point 427 near or at its first end 426, and an actuator (not shown) is used to rotate 425 the crank link 424 about a pivot axis, $\text{Axis}_{Pivot}$. At a second end 428, the crank link 424 is pivotally coupled or connected with the inner end 432 of the vehicle support link 430. At the outer end 438, the vehicle support link 430 supports a coupler 416 that is used to support (e.g., pivotally mounted) vehicle 410.

The vehicle support link 430 is supported at a midpoint 434 between ends 432, 438 by a pivotal connection 435 with an end or portion 442 of the follower link 440. The follower link 440 is supported at an opposite end 444 by base link 422 via pivotal connection 445. As shown, the base link 422 includes an inner opening (e.g., between spaced apart legs) through which the crank 424 may pass as it rotates 425 relative to the link 422 about axis 470 ($\text{Axis}_{Pivot}$). From the three sequential positions of the assembly 400 shown in FIGS. 4-6, it can be understood that the vehicle 410 is moved through a motion profile with lateral movement as well as vertical movement and that changes in the lengths of the links 422, 424, 430, 440 and/or their points of their connections (427, 429, 435, 445) will affect or define the motion profile of the vehicle 410 at the end 438 of vehicle support link 430. In contrast, some design practices may call for first defining the motion profile desired for a vehicle 410 and then using this profile to establish lengths of the four members or links of the four-bar linkage (and other parameters such as coupling point locations).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. As can be seen, the round rides with lateral flight may be relatively simple rides with a single input (rider input, ride controller providing control signals, or the like) to operate a single rotary actuator to drive the crank or driver link to select the position of the vehicle along a motion profile or coupling point path, which selects a vehicle's position (height/vertical position and radius/lateral position relative to the central axis of the rotable hub). In some embodiments, the actuator operates in response to user input such as via a joystick or other device in or on the vehicle. In other cases, the actuator is a constant velocity actuator that may be operated on an ongoing or intermittent (selectable such as by the rider or a ride controller) manner to rotate the crank or driver link, but even with such constant rotation the movement or output of the vehicle on the motion profile path will vary (in speed and the like due to use of four-bar linkage). In still other embodiments, the rotary actuator is programmable (e.g., with a ride program) to control movement of the drive link or crank (e.g., with a constant speed profile and/or with a varied rotation rate that may even include stops and/or reversals in rotation direction).

In use, the movement of the four-bar linkage of the support arm assembly causes the vehicle to fly in and out (flight pattern of vehicle that includes lateral movement as well as vertical changes). This changes the radius of the vehicle relative to the central hub radius. Differing four-bar linkage designs may be used (e.g., a longer vehicle support link for some vehicles) so as to provide different ride experiences within the same round ride (e.g., encourage teenagers/adults to have repeat rides along with younger kids desiring a "tamer" ride experience with lower centripetal accelerations). In some cases, the lowest point (or a lower point) of each motion profile is chosen to be the settling or stop point of the ride and the rotary actuator such that the vehicle is positioned at a low point to facilitate load/unload of the round ride.

I claim:

1. A round ride with lateral flight, comprising:

a drive assembly including a drive and a hub rotated, during operation of the drive, about a central axis of rotation;

a passenger vehicle; and a vehicle support assembly including a coupler supporting the passenger vehicle and a four-bar linkage including a base link attached to the drive assembly to rotate with the hub and a vehicle support link with an outer end connected to the coupler, wherein the four-bar linkage further includes a driver link pivotally connected at a first end to the base link and at a second end to an inner end of the vehicle support link and wherein the ride further includes an actuator operating to rotate the driver link about its connection point with the base link.

2. The ride of claim 1, wherein, when the driver link is rotated about the connection point, the passenger vehicle is moved along a motion profile with a path that positions the passenger in a vehicle in a range of vertical positions and a range of lateral positions relative to the center axis of rotation, whereby the passenger vehicle has lateral movement.

3. The ride of claim 2, wherein the lateral movement exceeds 2 feet.

4. The ride of claim 2, wherein the vertical positions in the path do not define a simple arcuate path.

5. The ride of claim 4, wherein the path includes at least two differing vertical movement paths.

6. The ride of claim 1, wherein the actuator operates in response to signals from a user input device on the passenger vehicle and wherein the signals cause the actuator to alternately move the driver link in a clockwise direction and a counterclockwise direction.

7. A round ride with lateral flight, comprising:

a drive assembly including a drive and a hub rotated, during operation of the drive, about a central axis of rotation;

a passenger vehicle; and a vehicle support assembly including a coupler supporting the passenger vehicle and a four-bar linkage including a base link attached to the drive assembly to rotate with the hub and a vehicle support link with an outer end connected to the coupler, wherein the four-bar linkage further includes a follower link pivotally connected at a first end to the base link and at a second end to the vehicle support link at a coupling point, wherein the coupling point is at a midpoint between the inner and outer ends of the vehicle support link such that the vehicle support link includes a cantilevered portion extending outward from the coupling point and supporting the passenger vehicle.

8. The ride of claim 7, wherein the cantilevered portion extends outward from about the coupling point at an angle with an absolute value of greater than about 15 degrees.

9. A round ride with varying lateral vehicle positions, comprising:

a central hub operable to rotate about an axis of rotation at a rotation rate;

a vehicle adapted for supporting a passenger;

a base link affixed to the central hub to rotate with hub;

a crank link pivotally connected at a pivot point to the base link;

a rotary actuator operable to rotate the crank link about the pivot point;

a vehicle support link pivotally connected to the crank link to move with the crank link, wherein the vehicle support link supports the vehicle about a coupling point at an end distal to the crank link; and a follower link pivotally connected at spaced apart pivot points to the base link and to the vehicle support link.

10. The ride of claim 9, wherein the crank link, the vehicle support link, and the follower link have lengths as measured between the pivot points such that the coupling point is moved through a motion profile with both vertical and lateral movement.

11. The ride of claim 10, wherein the lateral movement exceeds 2 feet and the vertical movement is along at least two paths having differing shapes.

12. The ride of claim 9, wherein the pivot point connecting the follower link to the vehicle support link is spaced apart from the coupling point by at least about 6 feet, whereby a cantilevered portion of the vehicle support link extends outward to support the vehicle.

13. The ride of claim 12, wherein the cantilevered portion angles away from the longitudinal axis of the vehicle support link at an angle having an absolute value of more than about 15 degrees.

14. An amusement park ride, comprising:

a drive assembly including a hub rotatable about a central axis;

support arm assemblies coupled to the hub, the support arm assemblies each including a coupler and an actuator actuating the correspond arm assembly to move the coupler laterally inward and outward toward the central axis; and on each of couplers, a vehicle configured for receiving one or more passengers, wherein each of the support arm assemblies comprises a four-bar linkage with a vehicle support link extending outward toward an outboard end to which the coupler is mounted, wherein the four-bar linkage is driven by the actuator, and wherein the four-bar linkage further includes a base link attached to the hub and a driver link pivotally mounted to the base link to be rotated by the actuator, the driver link further being pivotally mounted to an inboard end of the vehicle support link, whereby the coupler is moved through a motion profile.

15. The ride of claim 14, wherein the motion profile includes vertical displacement and lateral movement that causes a vehicle radius to vary with movement of the coupler to differing points in the motion profile.

16. An amusement park ride, comprising:

a drive assembly including a hub rotatable about a central axis;

support arm assemblies coupled to the hub, the support arm assemblies each including a coupler and an actuator actuating the correspond arm assembly to move the coupler laterally inward and outward toward the central axis; and on each of couplers, a vehicle configured for receiving one or more passengers, wherein each of the support arm assemblies comprises a four-bar linkage with a vehicle support link extending outward toward an outboard end to which the coupler is mounted, wherein the four-bar linkage is driven by the actuator, and wherein the four-bar linkage further includes a follower link pivotally connected to the base link and to the vehicle support link at a pivot point between the inboard and outboard end, whereby a cantilevered portion is defined that includes the outboard end.

17. The ride of claim 16, wherein the cantilevered portion is configured such that a coupling point between the coupler and the vehicle is offset from a longitudinal axis of the vehicle support link.

* * * * *